United States Patent [19]

Baldwin et al.

[11] Patent Number: 4,550,828

[45] Date of Patent: Nov. 5, 1985

[54] PORTABLE TOOL BOX

[76] Inventors: Arthur Baldwin; Mark Baldwin, both of 105 Market St., Rockland, Mass. 02370

[21] Appl. No.: 704,541

[22] Filed: Feb. 22, 1985

[51] Int. Cl.[4] ..... A43C 11/26; B65D 5/38; B65D 5/46; B65D 5/48

[52] U.S. Cl. ..... 206/349; 206/373; 206/372; 220/94 R; 312/DIG. 33; 312/283; 312/252

[58] Field of Search ..... 206/349, 372, 373, 198, 206/427; 220/94 R; 312/DIG. 33, 283, 252, 233

[56] References Cited

U.S. PATENT DOCUMENTS

| | | | |
|---|---|---|---|
| 1,268,124 | 6/1918 | Jennings | 206/349 |
| 2,954,898 | 10/1960 | Freeberg | 206/427 |
| 3,390,810 | 7/1968 | Schneeweiss | 206/198 |
| 4,294,348 | 10/1981 | Hastings | 206/373 |
| 4,460,085 | 7/1984 | Jantzen | 206/349 |

*Primary Examiner*—William T. Dixson, Jr.
*Attorney, Agent, or Firm*—M. Lawrence Oliverio

[57] ABSTRACT

A portable tool box having an open-top, box-like housing containing removable slats with apertures for holding tools in an upright position and a drawer slidably engaged within a drawer aperture in one wall of the housing. The drawer outer wall has an outwardly projecting shelf and a lip extending above the shelf. A cover disposed over the housing has an endwall which covers the lip for retaining the drawer in the housing. Preferably, the shelf extends around the perimeter of the housing for supporting bottom edge of one or more of the walls of the cover. The tool box cover is sturdy enough to be used as a stool.

9 Claims, 3 Drawing Figures

PORTABLE TOOL BOX

BACKGROUND OF THE INVENTION

Portable tool boxes are used by a variety of tradesmen such as carpenters, plumbers, and electricians. A tool box must hold a variety of tools and it is desirable to provide means for positioning the tools within the box such that a specific tool can be quickly identified amongst a variety of other tools and easily removed therefrom. It is also desirable to provide a tool box with replaceable means for holding a variety of different size tools, and since tools are generally very heavy, the tool box must be well-constructed. It would also be convenient to provide a tool box which could simultaneously be used as a seat and foot stool.

It is especially desirable to provide a tool box with a cover means which maintains a drawer provided therein shut while simultaneously rendering the drawer readily accessible by hand.

Tool boxes are known which include a shelf or shelves having apertures of various sizes to support elongated tools in an upright manner. See Hughes U.S. Pat. No. 1,629,213, Schmidt U.S. Pat. No. 4,266,835, Sautter U.S. Pat. No. 4,006,821, and Tedrow U.S. Pat. No. 4,211,455. However, none of these shelves are readily removable. It is also known to position elongated articles, such as pipettes, in an upright position between horizontally-disposed slats (Smernoff U.S. Pat. No. 3,819,042).

A known carrying box for the display of articles consists of a base, a vertical wall with display panels, and a cover mounted over the base (Chandles U.S. Pat. No. 4,387,940). The vertical wall is attached along one edge to the base and a handle extends from its opposing edge and is disposed in an aperture in the cover. The bottom edge of the cover has an endless notch-shaped groove which rests on the edge of the base.

It is an object of this invention to provide a portable tool box having a housing containing means for holding tools in an upright position and a drawer for holding additional tools.

Another object is to provide removable slats having apertures of a predetermined geometry for holding tools in an upright position, separate, and readily distinguishable from each other.

A further object is to provide a tool box having a drawer slidably disposed within a wall of the housing and a cover which maintains the drawer shut and simultaneously readily accessible for opening while the cover is still in place over the housing.

SUMMARY OF THE INVENTION

In accordance with the invention there is provided a portable tool box comprising an open-top housing having a housing bottom wall connected to a pair of opposed housing sidewalls and a pair of opposed housing endwalls, one of the housing endwalls having an aperture for a drawer, and one or more of the housing walls including an outwardly projecting shelf; a drawer slidably engageable within the aperture, the drawer including a face having a lip extending above the shelf; means disposed above the drawer aperture having a plurality of apertures for holding tools in an upright position above the drawer; and, an open-bottom cover having a cover top wall connected to a pair of opposed cover sidewalls and a pair of opposed cover endwalls, each of the pair of cover sidewalls and endwalls being spaced apart a distance sufficient for slidable engagement over the housing and into engagement with the shelf, the lip being covered by one of the cover endwalls when the cover is slidably engaged over the housing with the shelf, the shelf being disposed below the top of the lip.

One housing endwall having the aperture is preferably disposed at such an angle to the cover endwall covering the lip as to allow the lip to be exposed for slideable removal of the drawer from the aperture when the cover is tilted toward the angled housing endwall.

The tool holding means preferably comprises a plurality of slats, each of the slats having a plurality of apertures, each of the apertures having a predetermined geometry compatible with the geometry of selected tools. The slats are preferably readily insertable within and readily removable from the housing, the slats being arranged side-by-side within the housing. Most preferably each of the slats has the same length and width, and the inside length of the housing is approximately equal to the collective widths of the slats.

The shelf extends around the perimeter of the housing supporting at least two of the cover walls when the cover is closed over the housing.

The tool box of the invention preferably includes a central wall attached to the housing sidewalls, the central wall including a handle extending above the top of the housing. The cover top wall preferably includes means for receiving the handle when the cover is closed over the housing.

The shelf is preferably disposed at a horizontal level on the perimeter of the housing below the highest level of the lip when the drawer is closed within the aperture.

These and other objects and features of the present will be better understood and appreciated from the following detailed description of embodiments thereof, selected for purposes of illustration and shown in the accompanying drawings.

BRIEF DESCRIPTION OF THE DRAWINGS

Other objects, features and advantages will be apparent from the following detailed description of preferred embodiments taken in conjunction with the accompanying drawings in which.

DETAILED DESCRIPTION OF PREFERRED EMBODIMENTS

Following is a description of the most preferred embodiments of the present invention with reference to the drawings.

Figure 1:
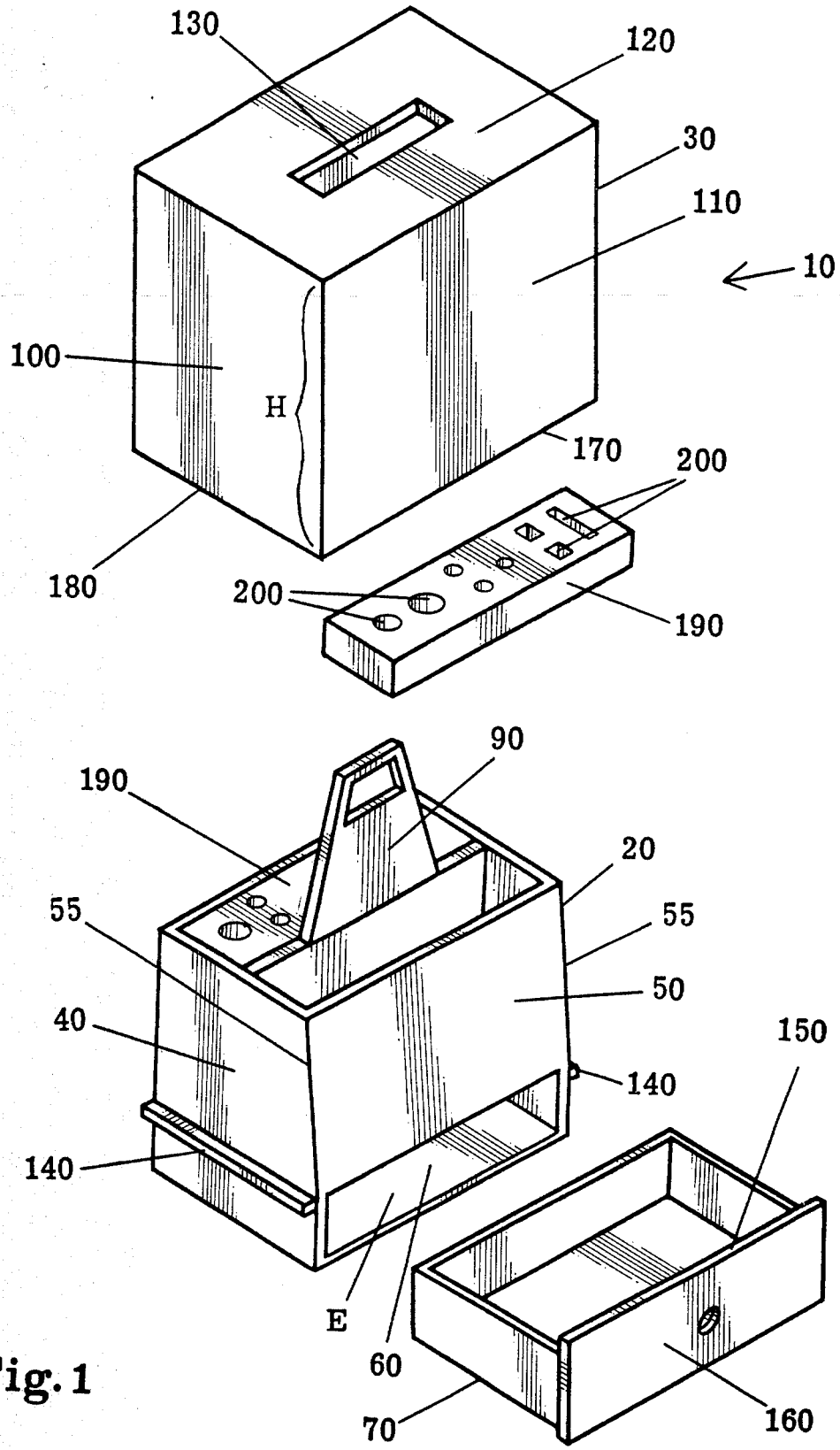
FIG. 1 is an exploded isometric view of the portable tool box of the present invention.

Shown in FIG. 1 is a portable tool box 10 comprising a housing 20 and a cover 30. The housing 20 includes a pair of sidewalls 40 and endwalls 50. The front endwall 50 includes an aperture 60 for slidably receiving drawer 70. The housing also includes a center wall 80 connected by conventional means to the sidewalls 40. The center wall includes an upwardly projecting handle 90.

The cover 30 includes cover sidewalls 100, endwalls 110, and a top wall 120 having an aperture 130 for receiving the handle 90. The cover walls 100, 110 are preferably disposed a slightly greater distance apart from each other than the housing walls 40, 50, so as to allow the cover to fit over and cover the open top of the housing 20.

Figure 2:
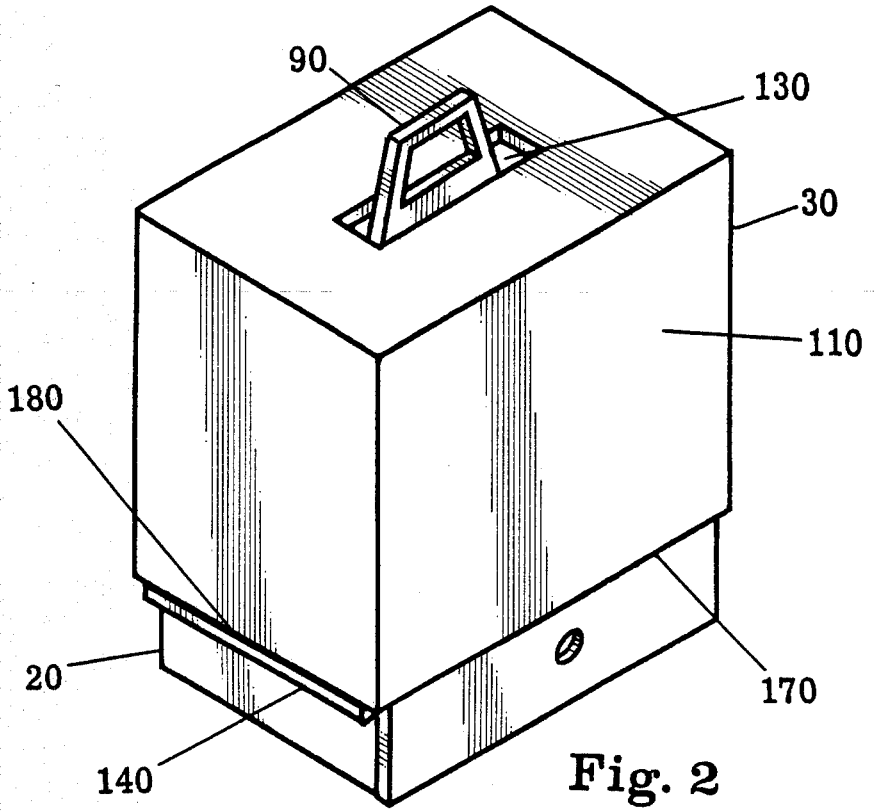
FIG. 2 is an isometric view of the portable tool box of the invention showing the cover closed over the top of the housing.

With reference to FIGS. 1, 2, when the drawer 70 is completely closed within aperture 60 the lip portion 150 of the face 160 extends above the horizontal level of disposition of a shelf 140 which extends outwardly around the outside perimeter of housing sidewalls 40. Such relative disposition of shelf 140 and lip 150 allows the bottom edge 170 of a cover endwall 110 to cover lip 150 when the bottom edges 180 of the cover sidewalls 100 come to rest on shelf 140 supporting the cover 30 above and around the housing 20. The shelf 140 preferably extends around the outside perimeter of housing 20 on at least the sidewalls 40 of housing 20 and preferably also the rear endwall of housing 20.

As shown in FIG. 2, when the cover 30 is completely closed over housing 20, the bottom edge 170 of the front cover endwall 110 covers the lip portion 150, FIG. 1, of face 160 of the drawer 70. When lip 150 is covered by the bottom edge 170 of wall 110, drawer 70 cannot be opened and the bottom edges 180 of cover sidewalls 100 rest on the top of shelf 140.

As shown in FIG. 1 the front edges 55 of front endwall 50 of housing 20 are preferably angled backwards relative to the front wall 110 of cover 30. Such angling of front housing endwall 50 allows the user of tool box 10 to gain access to and open drawer 70 without having to remove cover 110. Such access is demonstrated in FIG. 3 wherein cover 30 is shown tilted backwards against the angled edges 55 of front housing endwall 50 thereby exposing lip 150 of the face 160 of drawer 70. Once lip 150 is exposed by the tilting backwards of cover 30, the entirety of face 160 of the drawer is exposed and the drawer may be pulled out of aperture 60, FIG. 1, while the cover 30 remains closed over housing 20.

With reference to FIG. 1 the rear housing endwall of housing 20 may also be angled inwardly (similar to the angling of front housing endwall 50) in order to allow ready closing of cover 30 over housing 20 without undue friction or other interference from either of the front or back housing endwalls 50. Most preferably the left and right housing sidewalls 40 are also angled inwardly to further insure ready closure of cover 30 over housing 20. As shown in FIG. 2 when cover 30 is closed over housing 20, handle 90 extends through aperture 130 of cover 30.

Housing 20, FIG. 1, is provided with slats 190 preferably of uniform length and width. Slats 190 are preferably arranged side by side along their lengthwise dimension above drawer 70 within housing 20. The uniformity in size of slats 190 is preferred for purposes of simplicity of manufacture of the tool box 10. Although FIG. 1 depicts two slats, the tool box 10 may be provided with more than two slats, the preferred relationship of the slats to the housing being that the collective widths of the plurality of slats 190 is approximately equal to the inside width of the top of housing 20. The length of each slat 190 is preferably approximately equal to the inside length of housing 20.

Slats 190, FIG. 1, are provided with a plurality of apertures 200 each aperture preferably having a geometry predetermined to be compatible with the geometry of selected tools. The selected tools are placed within apertures 200 each aperture having a predetermined geometry compatible with the geometry of the selected tools such that when all of the selected tools are placed within their respective apertures, each tool is readily identifiable and distinguishable from each other. The slats 190 are disposed and fixed by conventional means within housing 20 above drawer aperture 60 such a distance that when the selected tools are placed within apertures 200 of slats 190, the selected tools are held above drawer aperture 60 so as not to interfere with the slidable movement of drawer 70 within aperture 60.

The height H FIG. 1 of each of cover sidewalls 100 and cover endwalls 110 is most preferably fixed at distance (typically between about 6 inches and about 24 inches and most preferably about 12–13 inches) which is convenient for user to sit on the top 120 of cover 30 for the purposes of using cover 30 separately, when removed, as a work stool. Thus, when cover 30 is removed and placed on the ground next to a work area, the user may comfortably sit on the cover 30 and have simultaneous access to the tools in the portable tool box 10.

Figure 3:
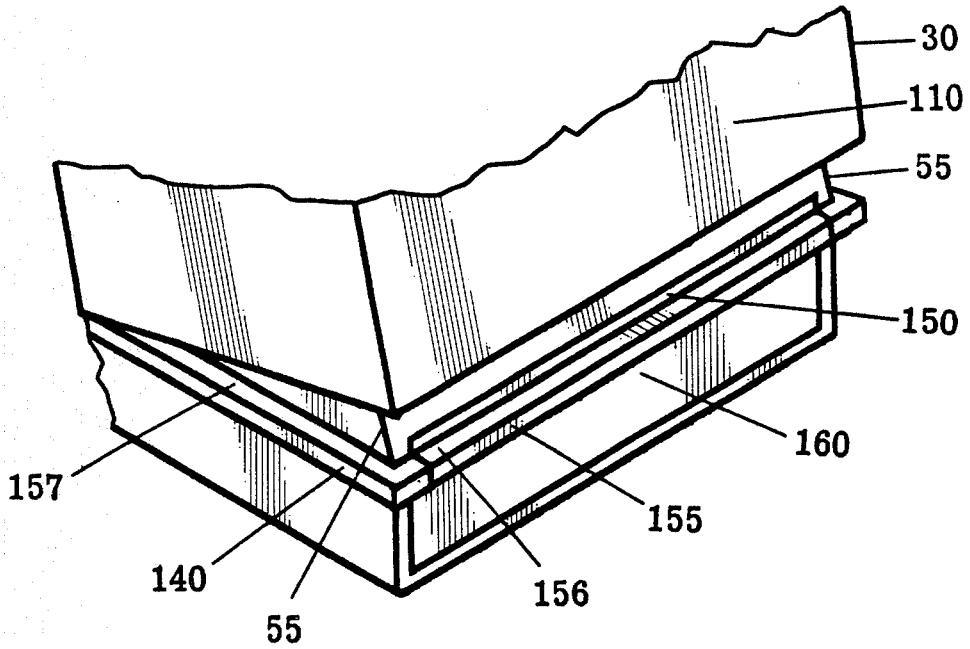
FIG. 3 is an isometric view of the portable tool box invention showing the cover in a tilted back position whereby the drawer lip is exposed for opening the drawer.

The lip 150 depicted in FIGS. 1 and 3 is shown as extending horizontally across the entire length of face 160 of drawer 70. The lip 150 may comprise, however, a variety of configurations such as projections, the only requisite configuration of the lip being that the highest point of lip extends above the level of the shelf 140 which supports the bottom of cover 30 when closed over housing 20.

The entirety of the tool box 10 of the invention may be constructed out of conventional materials such as wood, plastic and preferably metal for strength.

As shown in FIG. 3, drawer 160 is preferably provided with a handle 155 the top surface 156 of which coincides with the top surface 157 of shelf 140 so as to provide a continuation of shelf 140 on which cover 110 may further be supported.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A portable tool box comprising:

an open-top housing having a housing bottom wall connected to a pair of opposed housing sidewalls and a pair of opposed housing endwalls, one of said housing endwalls having an aperture for a drawer, and one or more of said housing walls including an outwardly projecting shelf;

a drawer slidably engageable within said aperture, said drawer including a face having a lip extending above the shelf;

means disposed above said drawer aperture having a plurality of apertures for holding tools in an upright position above said drawer;

an open-bottom cover having a cover top wall connected to a pair of opposed cover sidewalls and a pair of opposed cover endwalls, each of said pair of cover sidewalls and endwalls being spaced apart a distance sufficient for slidable engagement over said housing and into engagement with said shelf, said lip being covered by one of said cover endwalls when the cover is slidably engaged over the housing with the shelf, said shelf being disposed below the top of the lip.

2. The portable tool box of claim 1 wherein said one housing endwall having the aperture is disposed at such an angle to said cover endwall covering said lip as to allow said lip to be exposed for slideable removal of the drawer from the aperture when the cover is tilted toward the angled housing endwall.

3. The portable tool box of claim 2 wherein said tool holding means comprises a plurality of slats, each of said slats having a plurality of said apertures, each of said apertures having a predetermined geometry compatible with the geometry of selected tools.

4. The portable tool box of claim 3 wherein said slats are readily insertable within and readily removable from said housing, said slats being arranged side-by-side within the housing.

5. The portable tool box of claim 4 wherein each of said slats has the same length and width, and the inside length of said housing is approximately equal to the collective widths of said slats.

6. The portable tool box of claim 5 wherein said shelf extends around the perimeter of said housing supporting at least two of said cover walls when the cover is closed over the housing.

7. The portable tool box of claim 6 further comprising a central wall attached to the housing sidewalls, said central wall including a handle extending above the top of said housing.

8. The portable tool box of claim 7 wherein said cover top wall includes means for receiving said handle when said cover is closed over the housing.

9. The portable tool box of claim 6 wherein the shelf is disposed at a horizontal level on the perimeter of the housing below the highest level of the lip when the drawer is closed within the aperture.

* * * * *